United States Patent [19]

Smaw

[11] 4,018,031

[45] Apr. 19, 1977

[54] ARTICLE PACKAGING MACHINE

[75] Inventor: Jesse B. Smaw, East Paterson, N.J.

[73] Assignee: Marcal Paper Mills, Inc., East Paterson, N.J.

[22] Filed: Dec. 23, 1974

[21] Appl. No.: 535,789

Related U.S. Application Data

[62] Division of Ser. No. 254,989, May 19, 1972, Pat. No. 3,877,562.

[52] U.S. Cl. ..... 53/159; 53/189; 53/247; 53/258; 53/261; 53/266 R; 53/373; 53/379; 53/385; 198/425; 214/6 DK; 271/148

[51] Int. Cl.[2] ..... B65B 5/06; B65B 7/06; B65B 43/36; B65H 1/14

[58] Field of Search ..... 53/189, 188, 29, 61, 53/62, 385, 371, 372, 373, 378, 379, 147, 148, 159, 164, 247, 258, 261, 266, 267, 112 B; 221/91; 198/24, 106; 271/148; 214/6 DK, 6 F

[56] References Cited

UNITED STATES PATENTS

| | | | |
|---|---|---|---|
| 1,796,575 | 3/1931 | Morgan | 214/6 DK |
| 2,179,685 | 11/1939 | Chalmers | 53/371 X |
| 2,969,629 | 1/1961 | Blais | 53/62 X |
| 3,022,620 | 2/1962 | Gallet | 53/373 X |
| 3,145,517 | 8/1964 | Saumsiegle | 53/258 X |
| 3,174,260 | 3/1965 | Saumsiegle et al. | 53/186 |
| 3,239,218 | 3/1966 | Reeves | 271/148 |
| 3,287,882 | 11/1966 | Smith | 53/378 |
| 3,353,327 | 11/1967 | Cutler et al. | 53/373 X |
| 3,391,519 | 7/1968 | Keenan, Jr. et al. | 53/189 |
| 3,478,490 | 11/1969 | Sylvester et al. | 53/385 X |
| 3,490,195 | 1/1970 | Abramson | 53/189 X |
| 3,648,429 | 3/1972 | Davidson et al. | 53/373 X |
| 3,732,969 | 5/1973 | Formo | 53/159 X |
| 3,753,331 | 8/1973 | Sato | 53/385 X |
| 3,886,713 | 6/1975 | Mitchell et al. | 53/372 X |
| 3,930,352 | 1/1976 | Carnes | 53/189 |
| 3,945,171 | 3/1976 | Marietta, Jr. et al. | 53/112 B X |

FOREIGN PATENTS OR APPLICATIONS

| | | | |
|---|---|---|---|
| 1,247,216 | 8/1967 | Germany | 198/24 |

*Primary Examiner*—Othell M. Simpson
*Assistant Examiner*—Horace M. Culver
*Attorney, Agent, or Firm*—Burns, Doane, Swecker & Mathis

[57] ABSTRACT

An automatic packaging machine for sanitary paper products such as rolls of toilet tissue, packs of paper napkins, towels, etc. The machine comprises an article feeding section, a bag-supporting magazine section, and a package sealing section. The feeding section includes a reciprocal device having a support surface for underlying a plurality of articles and pushing means for moving the articles or packs. The feeding device is shifted in one direction from beneath a selected quantity of articles or packs to displace the articles downwardly, and in a reverse direction to push the displaced articles or packs into a wrapper to form a package. Continued movement of the feeding device causes the package to be transferred to the sealing mechanism.

A magazine section is provided for supporting an irregularly shaped stack of bags. The magazine includes hinged table sections which are automatically pivoted as the stack is raised. In this manner, the magazine compensates for uneven dimensional variations of the stack occurring during depletion thereof to maintain the uppermost bag generally horizontal.

The sealing section includes a stop arm for orienting a package on a support plate and devices for tucking in and heat-sealing the end flap of the package. A reciprocating mechanism is provided for automatically shifting the support plate to enable an ejecting plunger to push the package from the support plate following the sealing operation.

18 Claims, 24 Drawing Figures

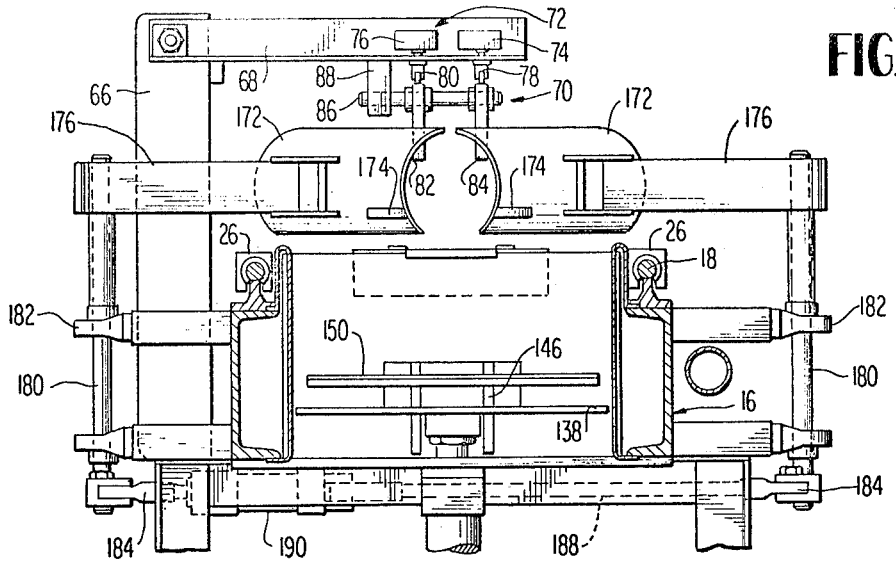
FIG.4
FIG.5
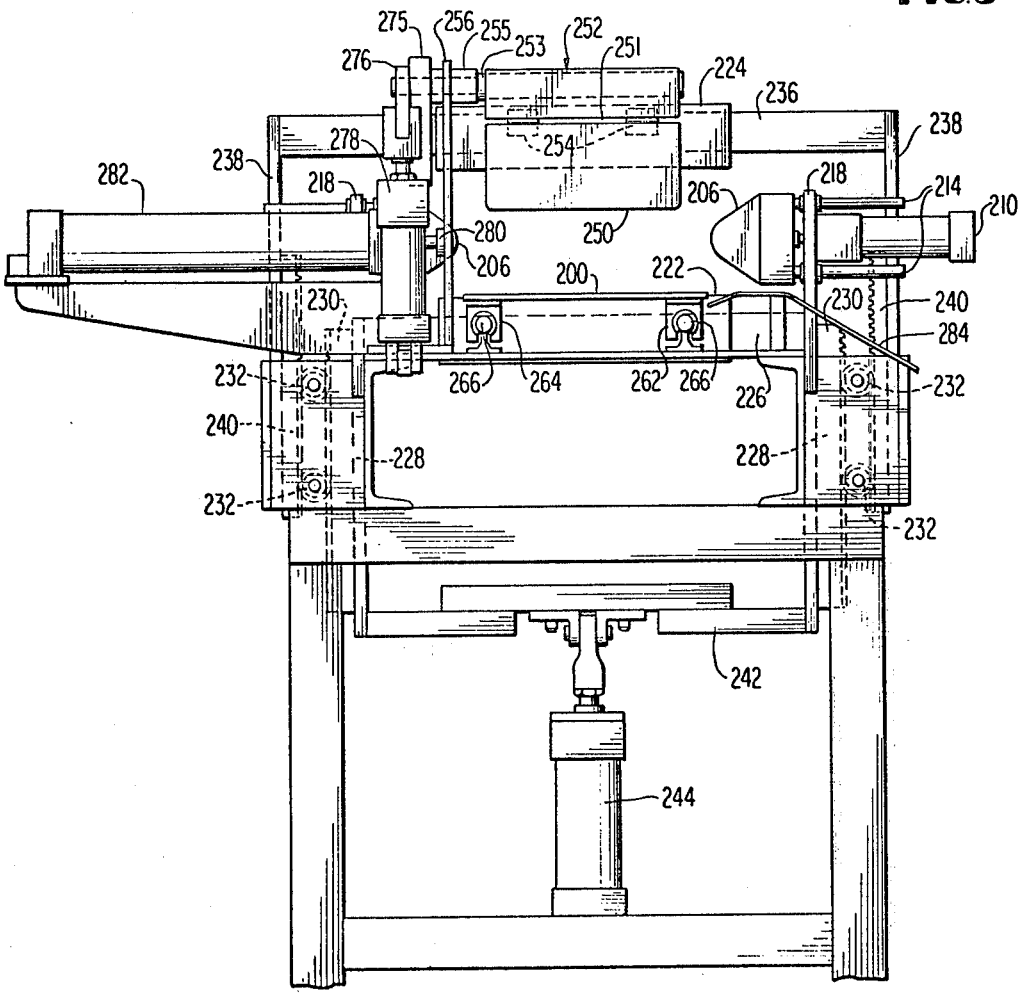

FIG.6
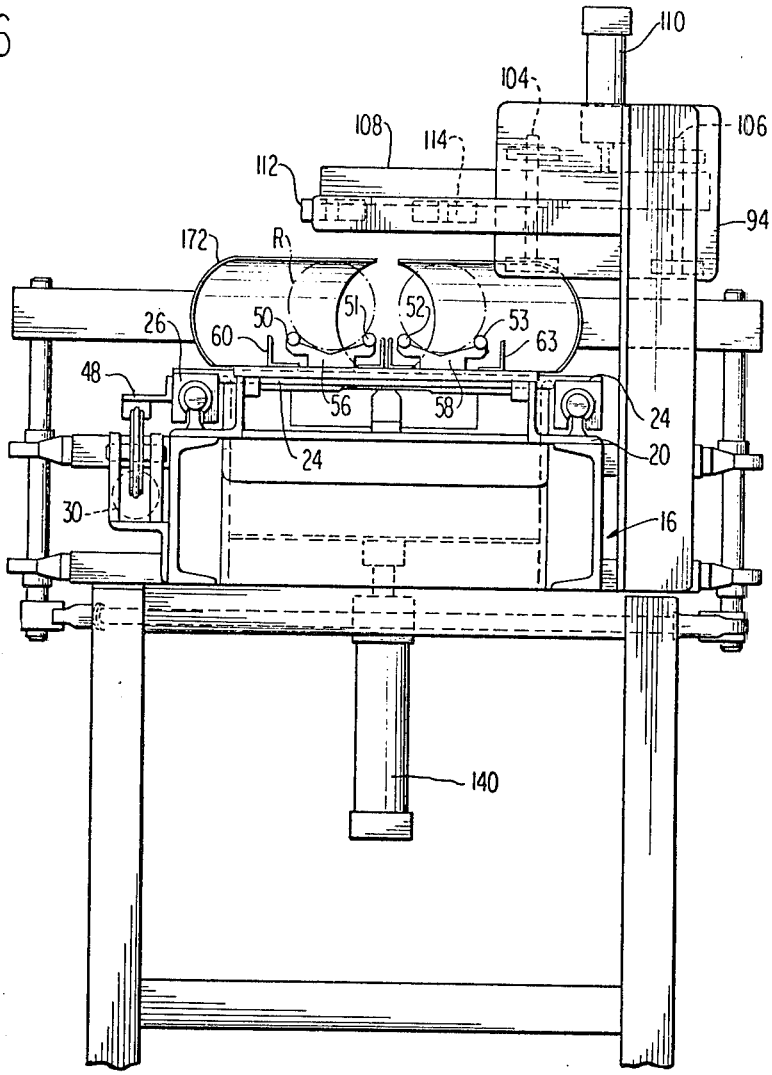
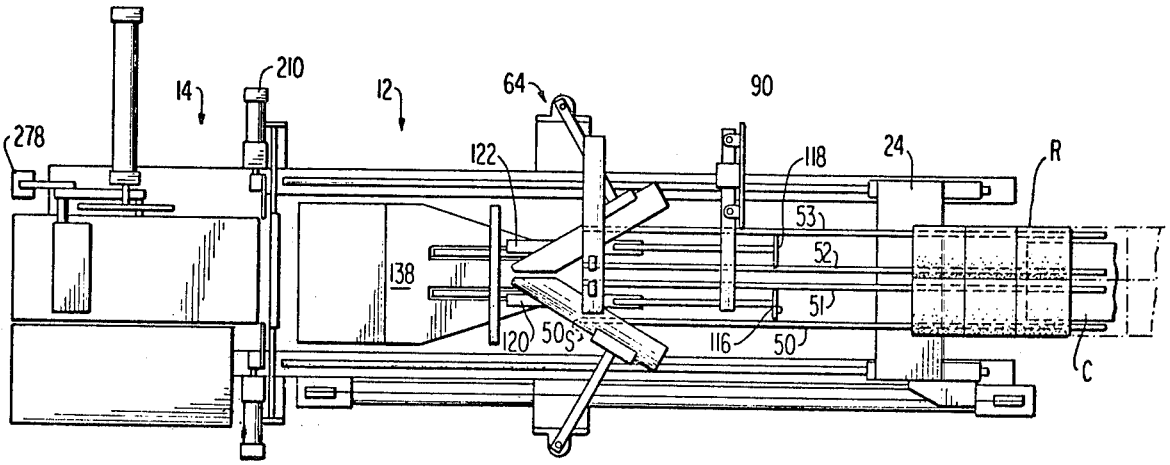
FIG.7

FIG.14
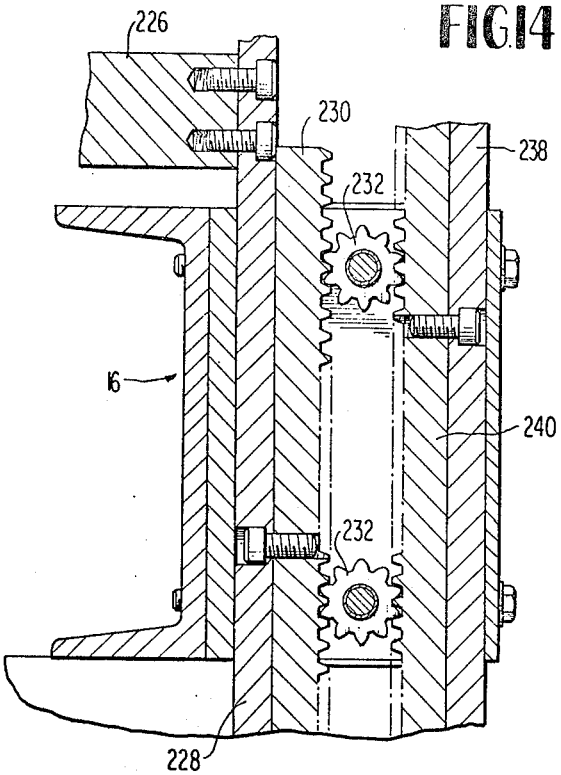
FIG.13a
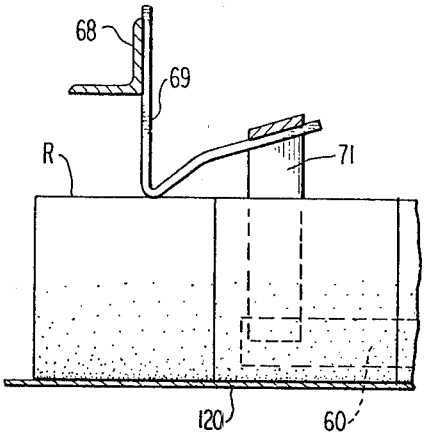
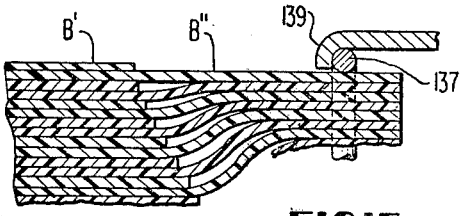
FIG.15
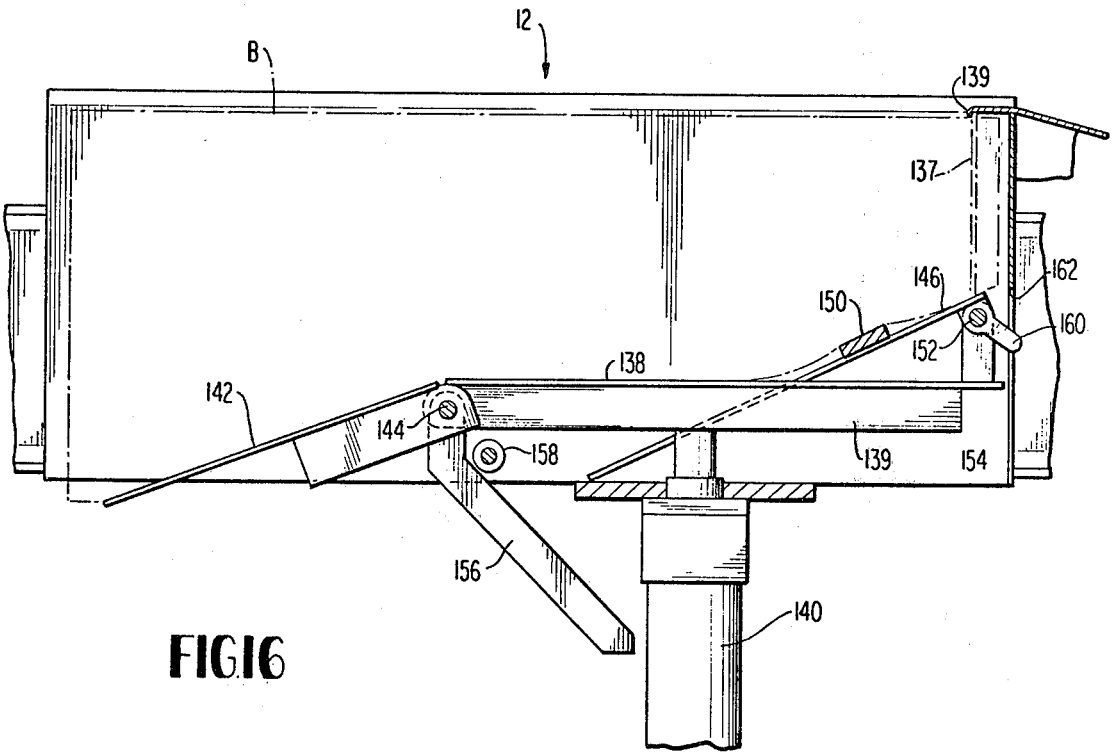
FIG.16

ARTICLE PACKAGING MACHINE

This is a division of application Ser. No. 254,989, filed May 19, 1972 now U.S. Pat. No. 3,877,562.

SUMMARY OF THE INVENTION

This invention relates to improvements in Article Packaging Machines and, more particularly, to devices for inserting articles into wrappers or bags to form packages and subsequently sealing the packages, all by automatic operation.

It has been proposed heretofore to insert articles into plastic bag-type receptacles by means of reciprocal pushing mechanism prior to closing and heat-sealing the bags. An example of an operation of this type is illustrated in U.S. Pat. No. 3,339,338, Sept. 5, 1967.

In conjunction with such operations, it is desirable that a suitable quantity of articles to be packaged, should be positioned at an injection station intermediate the receptacles and the pusher mechanism. While this can be accomplished manually, expensive labor costs may be encountered and it would render the packaging operation slow and tedious. Moreover, the high costs and increased size of complex mechanical devices for metering and positioning the articles has tended to reduce the practicality of automating these operations.

Previously proposed packaging assemblies have additionally included a magazine for supporting a stack of plastic bags which are sequentially opened and filled. Such operations have utilized a stack of bags which are closed at one end and open at the other. The bags are held together at their open end by a retaining clip. Stacks of this type may exhibit non-uniform dimensions wherein the stack is thicker at the closed end than at the open end. This non-uniformity may be initially compensated for by appropriately shaping the magazine table to properly orient the topmost bag for being mechanically opened and filled. Gradual depletion of the stack, however, may result in uneven changes in stack dimensions, causing subsequently filled bags to be improperly oriented.

Another problem in the art has been the provision of a fully automated apparatus which will fill receptacles effectively with articles and then seal the filled package.

One object of this invention is to simplify and improve the construction of an automated receptacle filling and sealing assembly to enable the assembly to be operated at high speed, and yet to be constructed at less cost and with less complexity and to require a substantial reduction in overall space for the use thereof.

Another object of the invention is to provide a compact article feeding mechanism which automatically meters a selected quantity of articles and inserts the articles into a receptacle such as a bag.

Still another object of the invention is to provide an article feeding operation wherein the same structure functions both to meter the articles and to insert them into the bags.

Yet another object of the invention is to provide a bag-supporting magazine for carrying a non-uniformly shaped stack of bags while automatically compensating for uneven dimensional changes in the stack during depletion thereof.

A still further object of the invention is to provide for automatically tucking, sealing, and ejecting a package of articles.

At least some of these objects may be accomplished according to one embodiment of the invention by providing an article packaging apparatus which includes a reciprocal article transfer mechanism. The article transfer mechanism includes a supporting surface for underlying and supporting a plurality of articles, packs, etc., and a pushing surface for engaging and transferring articles to a receptacle. Means is provided for shifting the supporting surface and the pushing surface from beneath a selected quantity of the articles to be packaged. Consequently, the articles are displaced downwardly to a position located between the pushing surface and the receptacle. Reciprocally shifting the pushing surface in the opposite direction causes the pushing surface to engage and push the articles into the receptacle.

According to a further aspect of the invention, the article transfer mechanism comprises two pairs of pusher arms. The peripheral surface portions of the pusher arms define the article supporting means in the form of two pairs of parallel guideways. The guideways are operable to support two continuous rows of articles, such as rolls of toilet paper, or packs of paper towels, napkins, and the like, as they are mechanically fed therealong. Terminal end walls on the arms define the pushing surfaces. A reciprocal piston is operably connected to the pusher arms to reciprocate the arms in one direction, causing a downward displacement of the rolls or packs, and in the opposite direction effecting an insertion of the articles into the package. A control arrangement is provided for automatically initiating the actions of the piston in response to appropriate orientation of the rolls or packs.

In another independently significant facet of the invention, a receptacle-supporting magazine is provided for carrying a stack of plastic bags. The magazine includes forward, and rearward sections for underlying and carrying corresponding sections of the stack. The rearward section initially lies in a downwardly sloping posture to accommodate the thicker stack at this end due to the folded over ends of the bags. Camming devices are provided for automatically varying the slope of the forward and rearward sections as the magazine table is raised. In this manner, uneven dimensional variences of the stack during its depletion tend to be compensated for such that the uppermost bag of the stack is kept in a generally horizontal orientation.

A bag-opening mechanism is provided and includes an air nozzle for directing a stream of air across the top of a bag, producing a vacuum over the bag. Consequently, the upper wall of the bag becomes lifted slightly, enabling the air stream to enter and inflate the bag. A pair of guide arms are pivotally mounted adjacent the bag in a manner operable to be swung into the opened bag to maintain the bag in an opened posture and to serve as a guide for articles being inserted into the bag.

In a further independently significant aspect of the invention, a package sealing mechanism is provided for automatically tucking and sealing the end flaps of a filled bag and subsequently ejecting the package. The sealing mechanism includes a shuttle plate for carrying a package. Significantly, the shuttle plate is disposed such that the package may be transferred thereto by the pusher arms which are employed to insert the articles into the package. A tucker plate assembly and a sealing jaw assembly are disposed adjacent the shuttle plate sequentially to tuck-in and heat-seal the end flaps of the bag. The shuttle plate is reciprocally arranged in a manner operable to move the sealed package clear of the tucker and sealing assemblies. In this fashion, an ejector, extending transversely of the shuttle plate, may engage and displace the package therefrom. A stop arm is provided for initially positioning the package on the shuttle plate and for accommodating movement of the package during the ejecting operation.

BRIEF DESCRIPTION OF DRAWINGS

This embodiment of the invention is illustrated in the accompanying drawings, in which:

FIG. 4 is a detail cross section through the machine, on the line 4—4 in FIG. 3;

FIG. 5 is an end elevation of the sealing end of the packaging machine;

FIG. 6 is an end elevation at the feeding end thereof;

FIGS. 7 through 10 are top plan views of the apparatus, in schematic presentation, illustrating the sequence of steps performed in the bag filling operations thereof;

FIG. 13*a* is a detailed side elevation, partly in section, showing an article retainer;

FIG. 14 is a partial cross-section of operating means for a pair of bag-sealing jaws;

FIG. 15 is a partial cross-section, in detail, of a stack of bags being held by a retaining clip;

FIG. 16 is a side elevation, partly in section, of the bag-supporting magazine;

DETAILED DESCRIPTION OF DISCLOSURE

Figure 2:
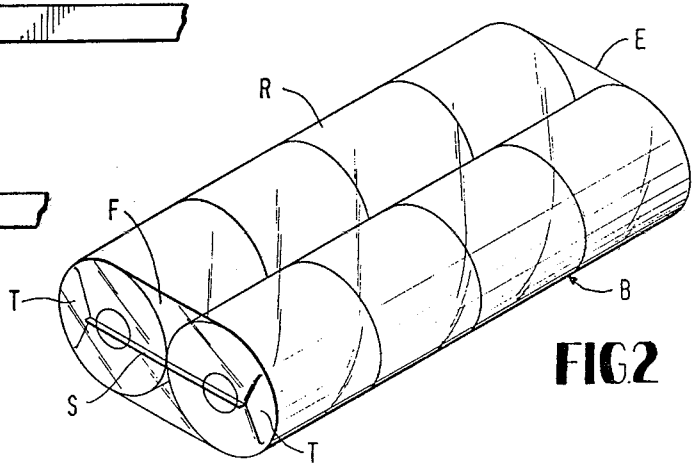
FIG. 2 is a perspective view of a package of rolls which has been formed and sealed according to the invention.

The invention is described in connection with the packaging of rolls of toilet tissue that are to be inserted in multiples, as 2, 4, 6 or 8, for example, in a suitable bag. An example of the completed package is illustrated in FIG. 2, having eight rolls R enclosed within a transparent polyethylene bag B. The latter has a closed end E and an initially open filling end F. In forming the package, the lateral edges of the bag B are tucked in as indicated at T, and the free edges of the bag B are then brought together and sealed along a transverse line S. The steps of accomplishing this operation will be described hereinafter.

Figure 1:
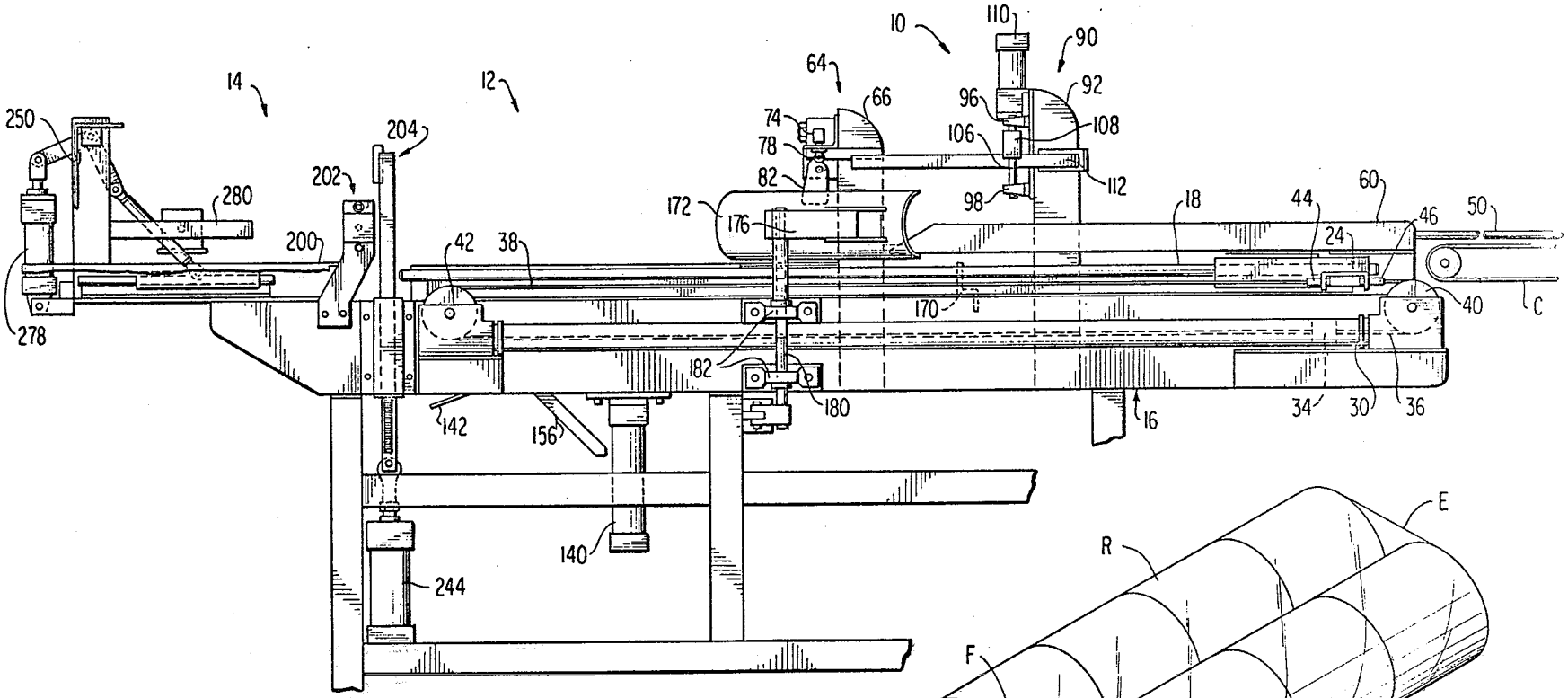
FIG. 1 is a side elevational view of a packaging machine showing the feeding, bag-supporting, and sealing sections thereof.
Figure 3:
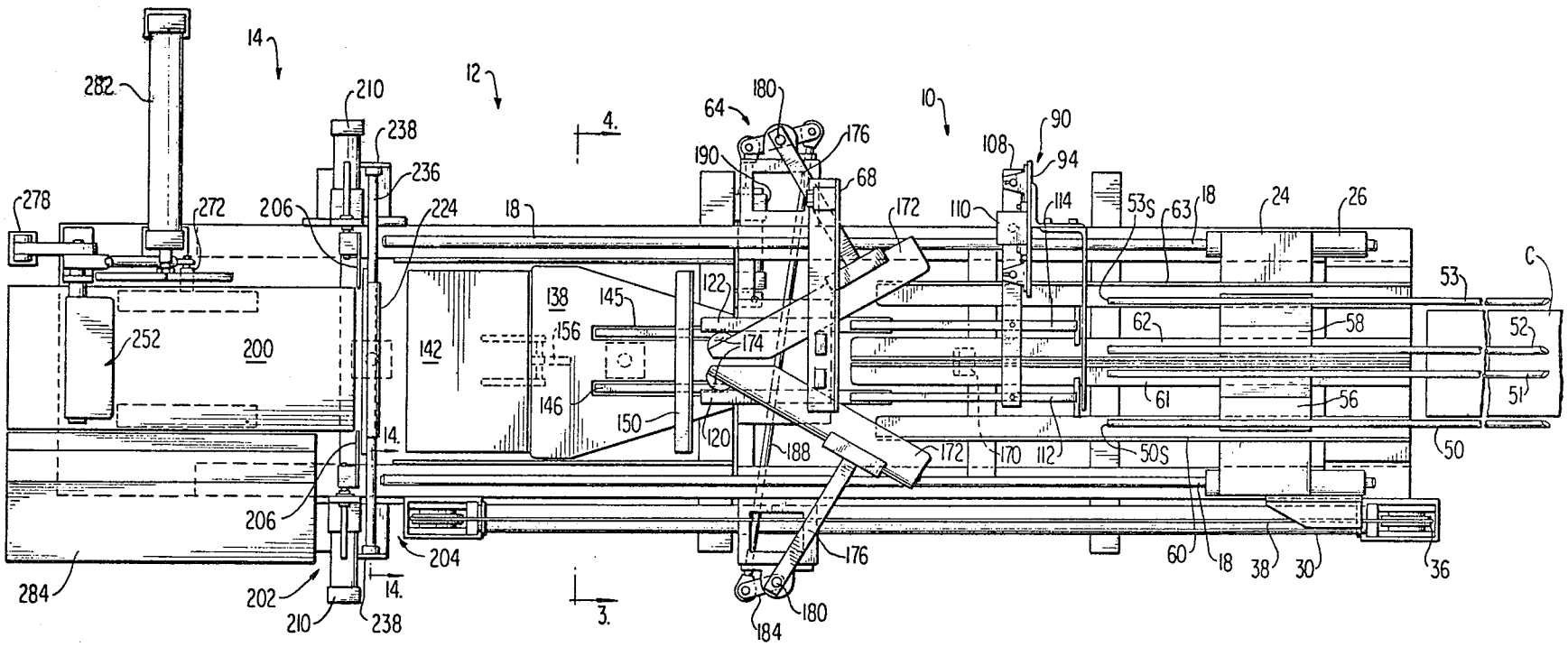
FIG. 3 is a top plan view of the packaging machine.
Figure 8:
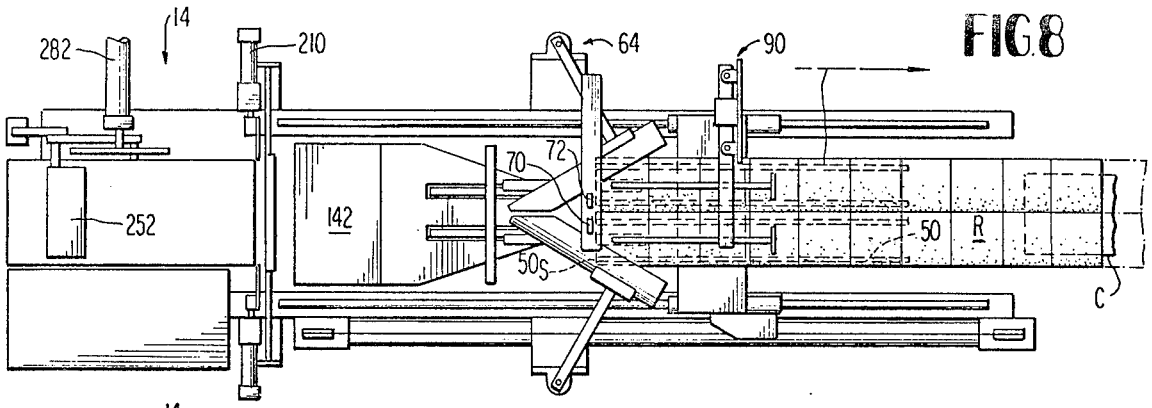
Figure 9:
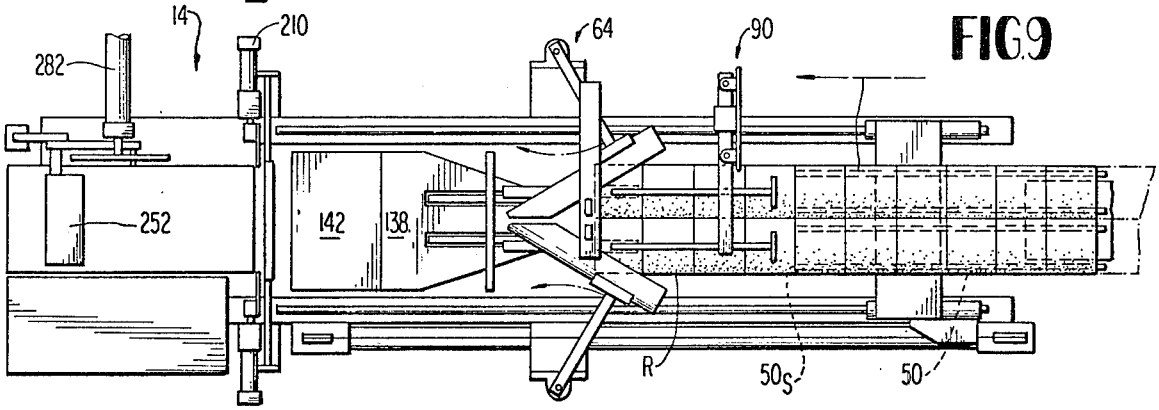

Referring to FIGS. 1 and 3, there is illustrated a packaging machine which generally comprises three basic sections, namely, a feed section 10, a bag magazine section 12, and a bag sealing section 14. These sections are mounted on a base frame assembly 16 which interconnects the sections into an integral unit.

Article Feeding Mechanism

The article feeding section includes a pair of guide rails 18 fixedly secured to a pair of upper longitudinal frame elements 20 (FIG. 6), which comprise part of the frame assembly 16. Positioned on the guide rails 18 for travelling movement therealong is a carriage plate 24. The carriage plate 24 extends transversely across the upper frame elements 20 and is secured to the rails 18 by means of downwardly projecting bearing blocks 26. The bearing blocks 26 have longitudinal openings therein to receive slidably the rails 18 (see FIG. 6).

A power mechanism (FIG. 1) in the form of a cable cylinder unit 30 is provided at one side of the machine for transmitting reciprocal movement to the carriage plate 24. The cable cylinder unit 30 comprises a cylinder 32 which is attached to one of the frame elements 20 and includes an internal reciprocal piston 34. Affixed to the piston 34 are a pair of cables 36 and 38. Each cable has one end secured to one end of the piston 34 and another end attached to the carriage plate 24. Intermediate its ends, the cable 36 passes around a sheave 40. In similar fashion, the cable 38 extends from the piston 34 around a sheave 42 spaced longitudinally at the opposite end of the machine. The cables 36 and 38 are secured to the piston 34 in any suitable manner and slidably extend through opposite end walls of the cylinder 32. Appropriate packing structure may be provided to seal the openings in the end walls through which the cables pass. The cables 36 and 38 are connected to the carriage plate 24 by means of sleeves 44 and 46, respectively, which are attached to one of the bearing blocks 26 by a bracket 48 (see FIG. 3).

The cylinder 32 is in communication with a source of compressed air (not shown), or other fluid under pressure, for selectively applying pressure to opposite sides of the piston 34. In this fashion, reciprocal movement may be transmitted to the carriage plate 24 through the cables 36 and 38.

Mounted on the carriage plate 24 are a series of four pusher rods or arms 50, 51, 52 and 53 arranged side-by-side in two pairs. The length of the pusher arms 50–53 will vary according to the number of rolls or the thickness of the articles, to be included in each package. The pusher arms are fixed to a pair of generally T-shaped blocks 56 and 58, there being two pusher arms attached to each block (see FIG. 6). The blocks 56 and 58 are secured to the carriage plate 24 wherein the carriage plate 24, the blocks 56 and 58 and the pusher arms 50–53 reciprocate as a unit. The pusher arms 50 and 51 are mounted on the block 56 in spaced, parallel relationship. The longitudinal peripheral surfaces of the arms 50 and 51 serve as tracks to define supporting surfaces for underlying and guiding a row of paper rolls R as shown in FIG. 6. The block 56 is appropriately recessed between the pusher arms 50 and 51 to accommodate the curved bottoms of the rolls. The remaining pair of arms 52 and 53 are connected to their block 58 in similar fashion to guide and support an adjacently disposed row of rolls.

The pusher arms 50–53 also include terminal ends which form pushing surfaces facing the bag magazine section 12. The pushing surfaces serve to insert the desired quantity of rolls R into a bag B as will be described in detail.

The rolls are delivered to the pusher arms 50–53 by means of an appropriate conveyor mechanism, such as a belt conveyor or conveyors C (see FIG. 1). The rolls travel in parallel rows which slide along guideways defined by the respective pairs of pusher arms.

The belt conveyor or conveyors C is continuously driven normally tending to urge the rolls forwardly through frictional contact therewith unless the forward movement of the rolls is restrained. The rolls sit in the conveyor surface which is located sufficiently close to the pusher arms 50–53 that the arms of each pair will be in embracing relation with the lower contour of the rolls in each line whereby each line of rolls will be transferred smoothly from the conveyor surface to the pusher arm surfaces.

Attached to cross-frame members 57 and 59 of the frame assembly 16 are two sets of parallel guide rails 60, 61 and 62, 63, which extend in a fore and aft direction. The guide rails 60–63 are shown as formed of angle bars and are disposed such that one rail of each set lies in an L-shaped posture and faces the other rail which lies in a reverse L-posture. The guide rails of each set are spaced so as to accommodate reciprocal passage of the pair of pusher arms therebetween. As will be explained subsequently, the guide rails 60–63 function to support a quantity of rolls after the rolls have been displaced from the pusher arms.

Overlying the frame assembly 16 is a switching mechanism 64 (see FIGS. 1 and 4). The switching mechanism 64 is secured to the frame assembly by means of an upstanding post 66 and an overhanging bracket 68, the bracket 68 being suitably secured to the post 66. The switching mechanism 64 includes a pair of electrical limit switches 70 and 72. The switches are identically constructed, each being associated for operation with a respective pair of pusher arms. The switches comprise electrical switches 74 and 76 which include vertically reciprocal plungers 78 and 80. Suitable switches may be purchased under the name Mead Micro Line Valve MV-30P. The switches are actuated by a pair of fingers 82 and 84 pivotally mounted on a common bar 86. The bar 86 is attached to the overhanging bracket 68 by means of a bearing fixture 88. The lower portions of the fingers 82 and 84 hang freely over the guideways defined by the respective pairs of pusher arms 50, 51 and 52, 53. The upper portions of the fingers are configured such that pivotal movement of the lower ends thereof, upon being engaged by rolls travelling on the pusher arms, causes the plungers 78 and 80 to be projected upwardly to actuate the switches 74 and 76.

Spaced from the limit switches 64 in a direction toward the article-receiving end of the machine is a stop assembly 90. The stop assembly 90 is attached to a post 92 which is upstanding on the frame assembly 16. A transverse plate 94 is secured to the post 92 and includes two pairs of vertically spaced brackets 96, 98 and 100, 102. The pairs of brackets serve to mount vertically extending guide rods 104, 106. A laterally extending beam 108 is mounted for vertical sliding movement on the guide rods 104, 106 by suitably placed apertures. A pneumatic or other power cylinder 110 is fixed to the transverse plate 94 and includes a downwardly extending reciprocal piston rod which is secured to the lateral beam 108.

Attached to the lateral beam 108 are a pair of fore and aft extending bars 112 and 114. As shown in FIGS. 3, 8, 9 and 10, the bars 112, 114, overlie and extend parallel to the guideways defined by the pairs of pusher arms 50, 51 and 52, 53. In this fashion, extension of the cylinder 110 causes these bars to be lowered toward rolls which may be positioned therebelow as will be described in connection with FIGS. 19 through 23. The bars also include stop plates 116 and 118 which are mounted at the ends thereof and extend in a lateral direction with respect thereto. The stop plates 116, 118 function to hold back the line of rolls and to separate the selected number of rolls to be packaged.

Figure 13:
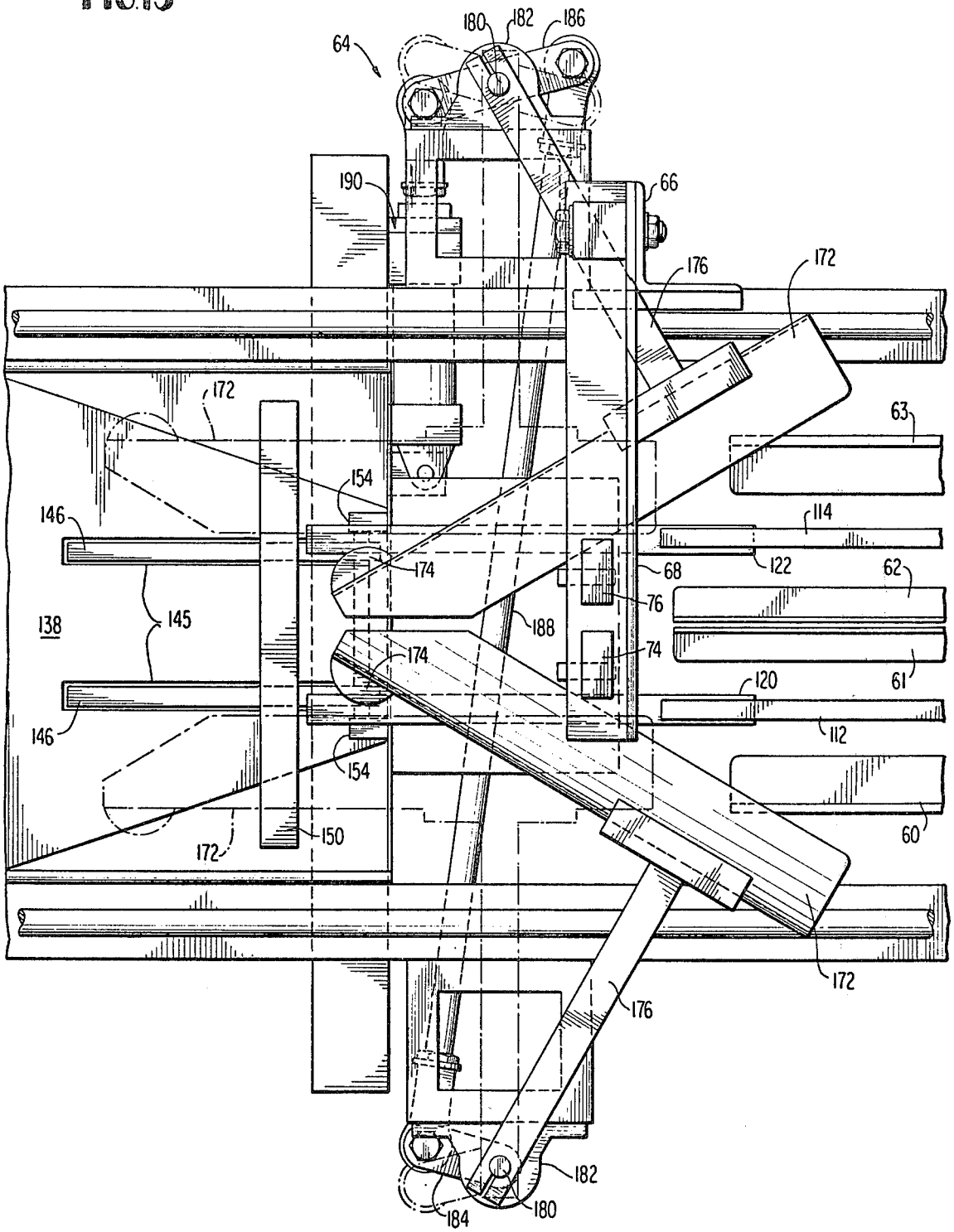
FIG. 13 is a detailed top plan view of an article-guiding portion of the apparatus.

Suitably attached to the frame assembly 16 are a pair of fore and aft extending guide strips 120 and 122 (FIG. 13). These strips, together with the guide rails 60 and 62 serve to underlie and support the lines of rolls after the pusher arms have been withdrawn therefrom.

Although the operation of the apparatus will be discussed later in detail, a brief explanation is presently in order. With the terminal ends of the pusher arms 50–53 being disposed generally beneath the switching mechanism 64, two rows of rolls R are pushed along the pusher arms by the conveyor C. When the forwardmost rolls contact and swing the fingers 82 and 84, the switches 74 and 76 will be activated, to cause the power cylinder 110 to operate and lower the bars 112 and 114. The cable cylinder 30 will be operated also to shift the pusher arms rearwardly from beneath a selected quantity of rolls as in FIG. 20. These rolls will drop onto the guide rails 60–63 and the guide strips 120 and 122 (see FIGS. 9, 20 and 21). Reciprocal shifting of the pusher arms in the reverse direction causes the terminal ends of the pusher arms, defining pushing surfaces, to contact and move the selected quantity of rolls toward and into the bag B (see FIGS. 10 and 22).

If the packaging machine be used for flat articles, such as paper napkins, paper towels, or the like, the desired quantity thereof to be included in each package may be separated by an operator, to be moved forward by the feeding means into the bag in the magazine.

Bag Magazine Mechanism

The bag magazine section 12 includes a bag-carrying table assembly to support a stack of bags B (see FIGS. 2, 3, 16 and 18). The overall configuration of the table assembly, as shown in FIG. 16, is such as to accommodate an irregularly-shaped stack of collapsed bags B. The bags, made of polyurethane or other suitable material, are pre-formed so as to be open, or unsealed, at their one end (facing the feeding section) and closed at their other end. The closed end is preferably formed by folding over the end of each bag and sealing it in this condition. Thus, a stack of such bags is thickest at its closed end as indicated in dotted lines in FIG. 16.

The unsealed end of each bag is formed in a manner such that the upper wall B′ of each bag terminates short of the lower wall B″, as illustrated in FIG. 15. The walls B″ of all the bags are retained in position by an inverted U-shaped clip, or wicket 137. The clip 137 passes through aligned apertures in the lower walls B″ and is maintained in position by means of a retainer bracket 139. The retainer bracket 139 is suitably secured to the frame assembly 16 and engages over the top of the clip in a conventionally known manner. As a result of this arrangement, the stack is of reduced thickness at the receiving end. Consequently, the table assembly is initially disposed so as to accommodate the decreased thickness of the stack. This tends to maintain the uppermost bag in a generally horizontal position when ready to receive the contents.

More specifically, the magazine table section comprises a generally horizontally disposed support plate 138 mounted on a support bar 139, affixed to the rod end of an upstanding power cylinder 140. The cylinder 140 is secured to the frame assembly 16 and communicates with a suitable source of fluid under pressure (not shown) for raising and lowering the support plate 138.

At one end of the table support plate 138 is a hinge plate 142 which is pivotally connected at 144 to the support plate 138 for upward and downward swinging movement with respect thereto. In this manner the hinge plate 142 accommodates the thick end of the stack, with the uppermost bag lying substantially horizontal.

In this connection, the hinge plate 142 is provided with a downwardly slanted lever 156. Mounted on the frame assembly 16 adjacent the lever 146 is a roller 158. As the support plate 138 is raised, the roller 158 is positioned to be contacted by the lever 156. Thus, the hinge plate is gradually shifted toward a horizontal or upwardly inclined position as the stack is being depleted (see FIG. 18).

The support plate 138 is slotted at 145 (FIG. 3) to accommodate a pair of support fingers connected together by a cross-bar 150. The fingers are pivotally connected at 152 to a pair of ears 154 (see FIGS. 13 and 16) which extend upwardly from the support plate 138. The fingers 146 and the cross-bar 150 define a support for the receiving end of the stack, the bottom of which stack slopes upwardly with respect to the support plate to compensate for the reduced stack thickness at the opposite end in maintaining the uppermost bag horizontal.

It will be apparent that as bags are being filled and removed from the stack, the stack dimensions will change in a non-uniform manner. That is, the thickness of the closed end of the stack decreases as bags are removed therefrom more than that of the filling end of the stack. In accordance with the invention, means are provided for compensating for uneven dimensional variances of the stack.

The fingers 146 are provided with levers 160 (only one shown in FIGS. 16 and 18) which abut a cam shoulder 162 of the frame assembly 16 as the support plate 138 is lifted. This results in the fingers being gradually shifted toward horizontal positions when the stack is substantially depleted.

The amount of incremental pivoting of the hinge plate 142 and of the fingers 146, is determined with a view toward maintaining the uppermost bag in a generally horizontal position for being properly opened and filled.

Bag Opening Mechanism

Figure 19:
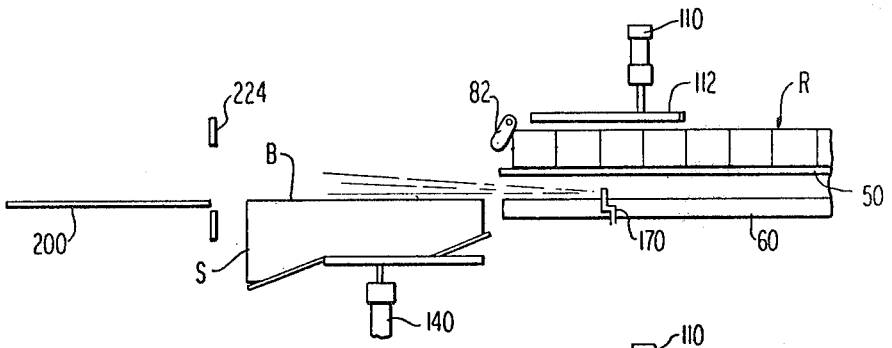
FIGS. 19 through 23 are diagrammatic views, in side elevation, illustrating the sequence of steps performed in filling a package.
Figure 20:
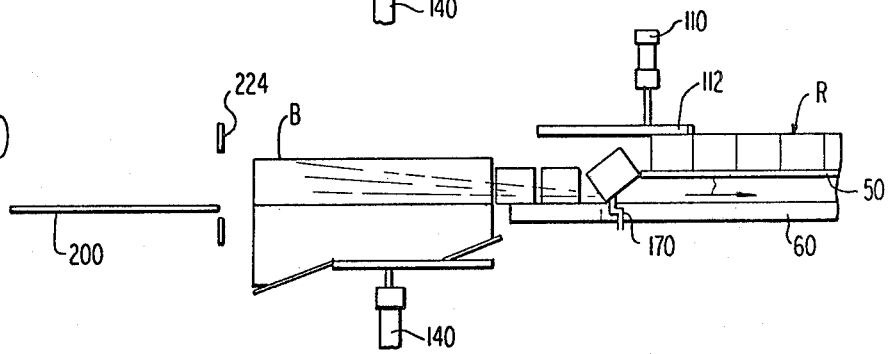

The packaging assembly further includes means for automatically mechanically opening the bags B. In this connection, an air nozzle 170 is disposed on the frame assembly 16 between the innermost ones of the guide rails 61 and 62, intermediate the switching mechanism 64 and the tamper assembly 90 (see FIGS. 1 and 3). The air nozzle 170 communicates with a source of air under high pressure and is located remote from the magazine 12. In this illustrated embodiment, the nozzle is spaced about 3 roll lengths from the magazine. The axis of the jet opening is such as to direct a blast of air across the upper wall B′ of the uppermost bag, as illustrated in FIG. 19 and spaced above the upper wall.

This produces a vacuum above the bag and causes the upper wall thereof to be lifted from the lower wall. The jet of air is directed sufficiently above the bag so that its force does not enter the bag. However, in order to fully open the bag after this top wall is raised by the vacuum of the air jet, a set of two guide wings 172 is provided. The guide wings comprise a pair of curved plates which are disposed at opposite sides of the frame assembly with their concave surfaces in generally facing relationship.

Each of the wings 172 for cylindrical articles, such as rolls of toilet tissue, is made semi-cylindrical for proper guiding of the articles when the wings have spread the bag open. When the top layer of the bag is raised somewhat with respect to the bottom layer, the wings 172 are operated to enter the bag and expand it to receive the articles. Each of the wings 172 is provided on the back of the forward end position thereof with a knob 174 on which the mouth of that bag engages. As shown in FIG. 13, the knob 174 is elongated and curved longitudinally. The mouth of the bag is stretched over these knobs 174 to facilitate holding the bag on the wings 172 and yet to allow the bag to be withdrawn by lengthwise pressure. The knobs 174 are below the center of the arc of the curved wings to avoid breaking the side seams of the bag.

Each guide wing 172 is mounted on a crank arrangement which enables the guide wings to be swung into and out of the bags. The crank arrangements comprise a pair of wing support arms 176 which are fixed to the upper ends of shafts 180 rotatably mounted on the frame assembly 16 by bearings 182 (FIG. 6). Secured to the bottom ends of the shafts 180 are crank arms 184 and 186. Interconnecting the crank arms 184 and 186 is a torque-transmitting rod 188.

As shown in FIG. 13, the crank arm 186 is extended on opposite sides of the shaft 180, one end of which is connected with the rod 188 and the other end is connected to a pneumatic cylinder 190, which is provided with a suitable source of gas or other fluid under pressure and is operable to rotate the guide wings 172 toward and away from each other and relative to the bag magazine section 12.

In a retracted condition of the cylinder 190, the guide wings 172 are disposed in a rest position away from the bag magazine section, as shown in full lines in FIG. 13. When a bag B has been partially opened by the suction on the top layer by the jet from the air nozzle 170, the cylinder 190 is extended. By means of the mechanical connection between the cylinder and the guide wings, the latter are simultaneously swung into the mouth of the bag to shape properly and to orient the opening for reception of a quantity of rolls R. The guide wings 172 also function to guide the rolls into the bag as they are forced by the pusher arms 50–53.

Sealing Mechanism

Figure 17:
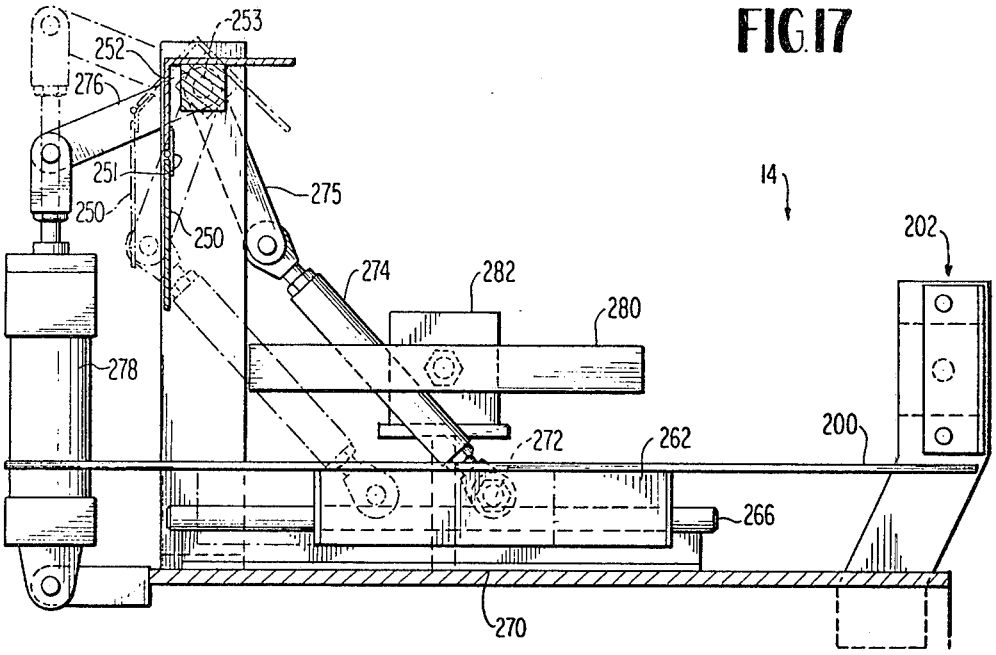
FIG. 17 is a side elevation, partly in section, of the sealing section of the apparatus.
Figure 18:
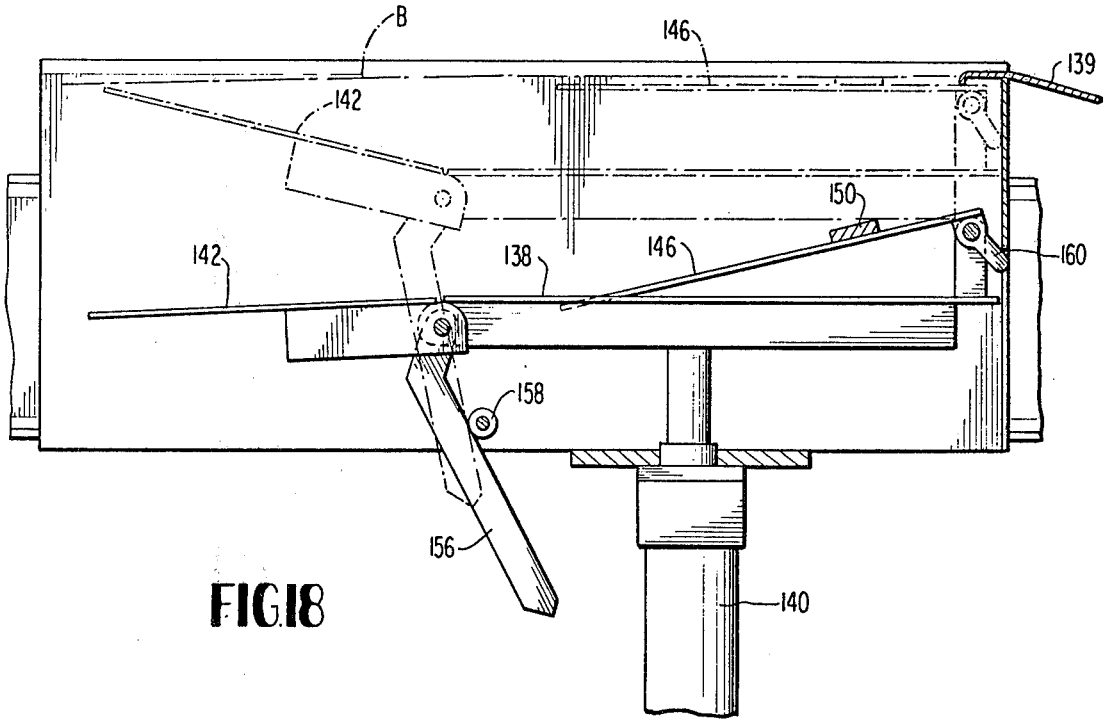
FIG. 18 is a view similar to FIG. 16 showing the bag-supporting table in a partially raised posture.

As shown in FIG. 17, the sealing section 14 includes a shuttle plate 200 which is disposed in generally horizontal alignment with the top of the stack of bags B. In this fashion, the filled packages may be pushed onto the shuttle plate 200 by the pusher arms 50–53. Mounted adjacent the entrance end of the shuttle plate are tucking and sealing assemblies 202 and 204, respectively, (FIG. 1), which are sequentially operable to tuck-in and seal the open end of a filled package which has been transferred to the shuttle plate 200.

The tucker assembly comprises a pair of tucker arms or plates 206 (FIG. 3), disposed on opposite sides of the shuttle plate 200 and are connected to the rod ends of pneumatic cylinders 210. The cylinders 210 communicate with a suitable source of fluid under pressure so as to be operable to project the tucker plates 206 inwardly toward each other in properly timed relation to the movement of the package. The tucker plates are each provided with a pair of guide pins 214 slidably mounted in an upstanding bracket to insure that the tucker plates will reciprocate rectilinearly and be maintained in upstanding relation to fold the bag end as indicated at T in FIG. 2.

The sealing assembly 204 includes a pair of vertically spaced, laterally extending lower and upper sealing jaws 222 and 224 (see FIGS. 3 and 5). The lower sealing jaw 222 is connected to an inverted U-shaped frame unit comprising a horizontal support 226 and downwardly extending legs 228. Attached to the outside faces of the legs 228 are gear racks 230 which are in mesh at each side with a pair of pinions 232.

The upper sealing jaw 224 is also connected to an inverted U-shaped frame which comprises a horizontal support 236 and downwardly extending legs 238. The legs 238 of the upper frame are arranged so as to straddle the legs 228 of the lower frame. The inside faces of the legs 238 are provided with gear racks 240 which are also in mesh with the opposite sides of the pinions 232 (FIG. 14). The legs 228 of the lower frame are connected together by a bar 242 (FIG. 5). An upright power cylinder 244 has its rod end operatively attached to the connecting bar 242 and is in communication with a source of fluid under pressure so as to be operable to reciprocate vertically the lower sealing jaw 222. The upward movement of the lower sealing jaw 222 is transmitted by the rack and pinion mechanism 230, 232, and 240 to the upper jaw 224, wherein an equal, but oppositely directed, force is applied to the upper sealing jaw 224. Thus, when the cylinder 244 is extended, the sealing jaws converge toward the end flaps of a bag to form the sealed lips S (FIG. 2); when the cylinder is retracted, the jaws open.

The sealing jaws 222 and 224 may be connected in a conventional manner to an appropriate heating source to heat the pressure surface thereof. In operation, the jaws will be heated to a temperature great enough to soften the plastic material of the bags.

When a filled package is deposited onto the shuttle plate 200 the end flaps of the bag within the vertical plane of movement of the sealing jaws 222, 224. The tucker plates 206 are then operated toward opposite edges of the package to tuck in the opposite sides of the open end. Then, the sealing jaws 222, 224, are operated to converge and to fuse together the flaps of the bag and thus form the sealed lip S (FIG. 2). A suitable suction assembly (not shown) may be provided for removing portions of the end flaps which have been severed during the sealing operation.

In order to insure that the end flaps of the filled bag will extend into the plane of the sealing jaws when the package is pushed onto the shuttle plate 200, the sealing section includes a stop plate 250 suspended in the path of the package in this shuttle plate (see FIG. 5).

The stop plate 250 is hinged at 251 to a support plate 252 mounted on a cross shaft 253. The stop plate 250 is yieldably retained in an upright position by one or more leaf springs 254 fixed at one end to the support plate 252 and bearing on the back face of this stop plate. The cross shaft 253 is rotatably mounted in a bearing sleeve 255, attached to the frame assembly by means of a bracket 256. The stop plate is maintained at a height sufficient to enable the closed end of a package to abut against the stop plate 250. The hinged support of the stop plate 250 will maintain it yieldably in different vertical positions for different angular positions of the support plate 252.

When a filled package is pushed onto the shuttle plate 200, the closed end of the package will abut the stop plate 250. The stop plate is situated such that the flaps of the unsealed end of the bag will lie within the plane of the sealing jaws. Thus, the stop plate 250 provides a simple but effective means of properly orienting the package.

Once the package has been sealed, it is intended that it be ejected laterally from the machine. Prior to this, however, it is necessary that the sealed end of the bag be moved from out of the tucking assembly 202. In accomplishing this, the shuttle plate 200 is mounted on bearing blocks 262 and 264 (FIG. 17) at opposite sides. The bearing blocks are arranged to slide on a pair of rails 266 which are fastened to a fixed frame support 270. One of the bearing blocks 264 is provided with a laterally extending projection 272. A coupling rod 274 is connected between the projection 272 and a lever 275 which is attached to the cross shaft 253.

A crank arm 276 is also affixed at one end to the cross shaft 253 and to a power cylinder 278 at the other end. The power cylinder 278 is in communication with a source of fluid under pressure for rotating the cross shaft 253.

With this arrangement, it is apparent that extension of the power cylinder 278 will rotate the lever 275 to transmit a sliding movement to the shuttle plate 200. Consequently, a sealed package carried by the shuttle plate will be shifted away from the tucker and sealing assemblies.

Figure 12:
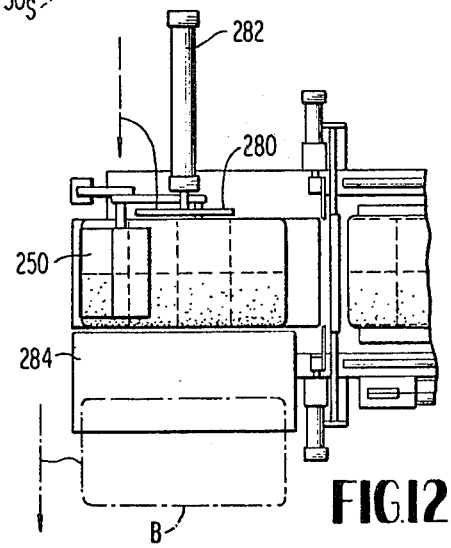

An ejector mechanism may be provided if desired. In this embodiment I have shown an ejector mechanism, in the form of a plunger bar 280 (FIGS. 1 and 3), attached to the rod end of a fixed pneumatic or other cylinder 282. Extension of the cylinder 282 after a sealed package has been moved away from the sealing and tucker assemblies causes the package to be pushed from the shuttle plate 200 and onto a ramp 284 (see FIG. 12). The ramp 284 is attached to the frame assembly 16 and may terminate adjacent a suitable conveyor or receptacle (not shown) where the sealed packages are received or accumulated.

OPERATION

In operation, the pusher arms 50–53 are initially disposed with their terminal ends being generally disposed beneath the switching mechanism 64, as illustrated in FIGS. 7 and 19. Two rows of rolls R are fed by the conveyor C onto the other ends of pusher arms. The rolls in each row travel along a respective pair of pusher arms until the leading rolls abut and rotate the cams 82 and 84 to actuate the switches 74 and 76 (see FIG. 13). Actuation of the switches produces a signal which operates the cable cylinder 30 (FIG. 1) and the power cylinder 110 of the stop assembly 90. In this manner, the pusher arms 50–53 are shifted rearwardly from beneath a selected quantity of rolls and the stop bars 112, 114 are then lowered into the path of the following rolls supported in the retracted packer arm.

The number of rolls to be included in one package is dropped from the retracted pusher arms 50–53 onto the guide rails 60–63 and the guide strips 120, 122 where they may be retained by yieldable holders 69 (FIG. 13*a*) if desired. These holders are in the form of leaf springs having an intermediate lower area bearing upon the rolls R with the ends of the springs secured to the bracket 68 and to a bracket 71 supported on the guide rails, and extending in bridging relation therebetween.

Figure 10:
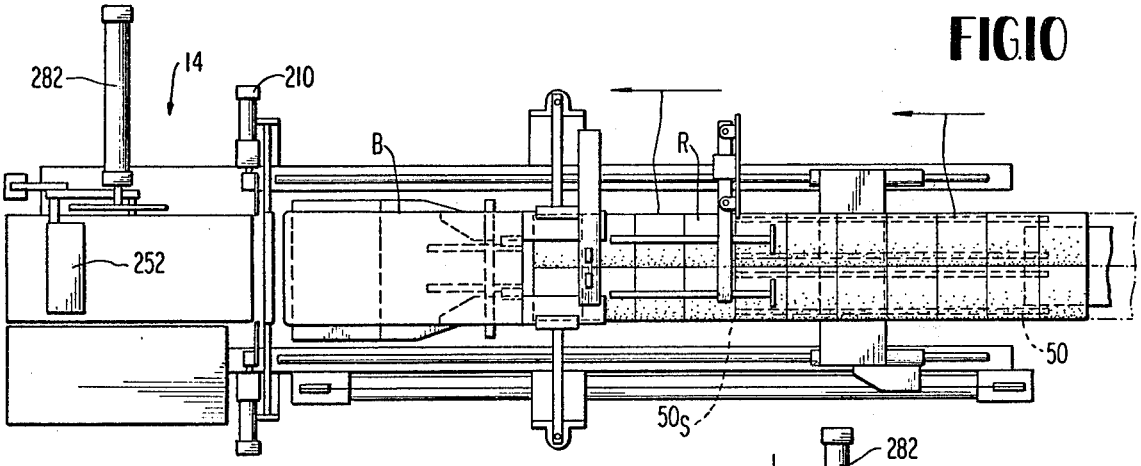
Figure 11:
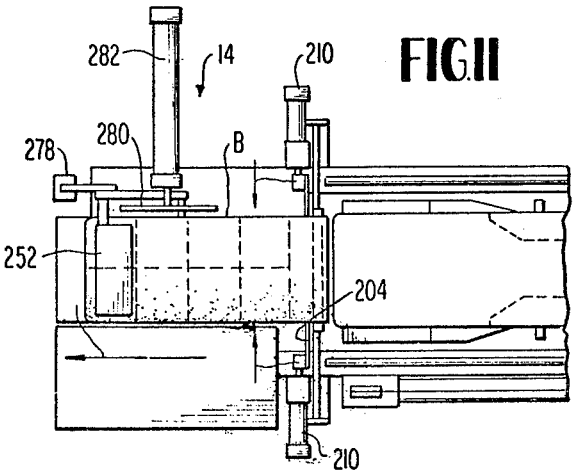
FIGS. 11 and 12 are partial top plan views illustrating diagrammatically steps performed during the sealing and ejecting of a package.
Figure 21:
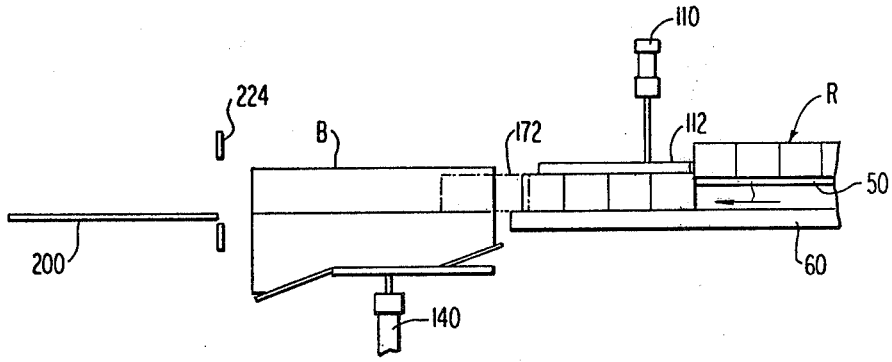
Figure 22:
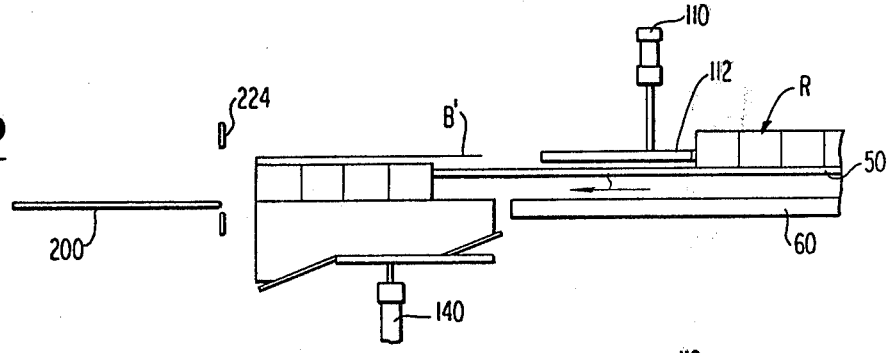
Figure 23:
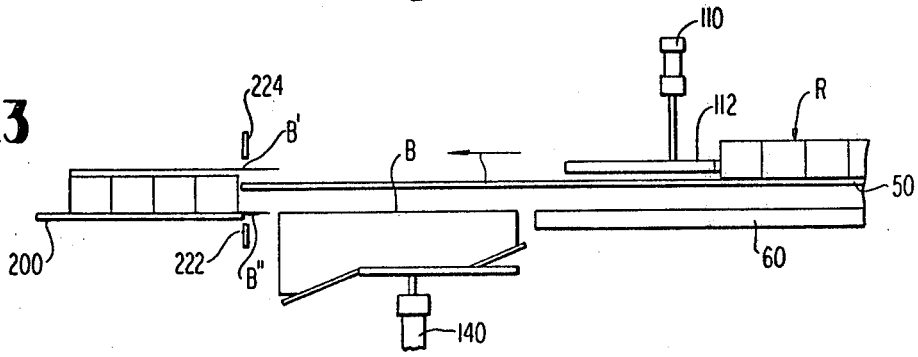

Actuation of the switches 74 and 76 also produces a signal which activates the bag-opening mechanism. Thus, a stream of air is emitted from the nozzle 170 in a line spaced above the top of the uppermost bag. The vacuum which is created thereby acts on and lifts the upper wall of the bag. The guide wings 172 are swung into the mouth of the bag by the power cylinder 190, as illustrated in FIGS. 10 and 21 and spread the mouth fully open. In this posture, the guide wings are in general alignment with the outermost guide rails 60 and 63 and assist in the supporting of the displaced rolls.

When the selected quantity of rolls R have been displaced from the pusher arms 50–53, the forward ends of the pushing arms will face the end ones of these selected rolls. At the end of the rearward stroke of the cable piston 34, the cable cylinder 30 is automatically actuated to reverse the movement of the pusher arms. The pushing surfaces of the arms 50–53 thus engage and push the rolls toward and into the open bag. During transfer of the rolls toward the bag, the rolls are supported and guided into the bag by the concave opposed faces of the guide wings 172.

Continued movement of the pusher arms, after the rolls have been inserted into the bag, causes the lower wall B″ (FIG. 15) of the bag to be pulled from the wire clip 137. The filled package is then transferred onto the shuttle plate 200 of the sealing section 14 until it abuts the stop plate 250.

At this point, the pusher arms are automatically retracted to their initial position beneath the switching mechanism; the wings 172 are swung rearwardly to their rest position (full lines in FIG. 13); and the stop bars 112 and 114 are raised. With the stop bars no longer obstructing movment of the rolls located on the pusher arms, these rolls travel toward the switching mechanism under the influence of the moving conveyor C to begin a new packaging cycle.

Once the filled package is suitably situated on the shuttle plate 200, the power cylinders 210 are automatically operated to extend the tucker plates 206 horizontally inwardly against the open end of the package just rearwardly of the rolls therein. The sides of the open end are thus tucked in toward the center of the package end as indicated at T in FIG. 2. At the same time, the power cylinder 244 is automatically expanded to close the heated sealing jaws 222 and 224 against the bag end flaps. The top and bottom portions of the end flaps become fused together, forming a neat and compact seal, indicated at S in FIG. 2. Waste portions of the end flaps which have been severed by the sealing jaws are sucked away by a suitably disposed suction unit or by other suitable means.

Following the sealing operation, the tucker plates and sealing jaws are automatically retracted to their rest positions. Subsequently, the power cylinder 278 automatically extends to shift the shuttle plate 200 forwardly and move the sealed package clear of the tucker and sealing assemblies. The plunger bar 280 is then automatically extended by the cylinder 282 to push the sealed package onto the discharge ramp 284. Any other suitable means may be used to remove the package.

With respect to the bag magazine section 12, it is noted that after a bag has been filled and transferred from the stack, the cylinder 140 is automatically extended by a predetermined increment to position the topmost bag in appropriate orientation for being filled. Upward movement of the support plate 138 (FIG. 16) causes the hinge plate 142 and the support fingers 156 to be rotated slightly due to engagement of the levers 156 and 160, respectively, with the roller 158 and the shoulder 162, respectively. This tends to compensate for the uneven dimensional changes in the stack which occur at the forward and rearward portions of the stack due to the removal of a bag. The topmost bag will thus be situated in a more nearly horizontal posture.

The several operations as described are controlled by electrically operated valves and switches, which are controlled in proper sequence by suitable limit switches, the operation of which is well known in the art and need not be described in detail.

Although the invention has been discussed in connection with the packaging of plural rows of articles, it will be understood that a single row of one or more articles could be packaged in accordance with the teachings of the invention. Moreover, articles of any convenient shape, other than cylindrical, may be packaged by merely adapting the configuration of the various supporting surfaces to the shape of the articles.

As will also be apparent from the foregoing description, this invention provides a compact assembly which automatically fills and seals a package. Significantly, the assembly employs a reciprocal arm mechanism which operats to support a plurality of articles, displaces a selected quantity thereof, inserts the selected articles into a bag, and transfers the filled bag for sealing. The bag-supporting magazine operates to orient automatically the bags during depletion of the stack to assure that they will be opened effectively and filled. The sealing unit comprises a simple, yet effective assemblage of elements for automatically sealing and ejecting a package.

While the article feeding section 10 (FIG. 1), the bag magazine section 12, and the package sealing section 14 have been described in connection with a single packaging assembly, it will be understood that each of these sections contains independently significant features and may be separately utilized with other forms of packaging devices.

While the invention has been illustrated and described in one embodiment, it is recognized that variations and changes may be made therein without departing from the invention set forth in the claims.

I claim:

1. An article packaging assembly comprising: receptacle supporting means; article transfer means reciprocable forwardly and rearwardly and having a substantially horizontal supporting surface for underlying and supporting a quantity of articles; conveyor means for delivering articles onto a rear end of said supporting surface and continuously urging said articles in the forward direction of reciprocation of said article transfer means, so that said supporting surface continuously carries a plurality of continuously forwardly urged articles; means for sensing arrival of an article at a forward end of said supporting surface and for actuating said reciprocating means in response thereto; a second substantially horizontal surface spaced at a lower elevation than the first-mentioned surface, means for advancing a plurality of articles substantially horizontally along said supporting surface to establish a horizontal row of articles aligned substantially horizontally on said supporting surface above said second surface; means for reciprocating the article transfer means relative to said second surface: rearwardly from underlying support of a selected plurality of said articles to displace the selected plurality of articles to the lower level of the second surface while maintaining others of said articles in supported relation on said supporting surface; and thereafter to forwardly engage and push all of the displaced selected articles into a receptacle carried by the receptacle supporting means, and stop means for resisting forward movement of said other articles as they are continuously urged forwardly by said conveyor means, while said supporting surface pushes said selected articles into the receptacle.

2. A bag-supporting magazine for use with a packaging assembly having means for opening bags and inserting thereinto, the magazine comprising: a table mechanism operable to carry an irregularly-shaped stack of collapsed bags in a manner tending to maintain the uppermost bag in a selected posture, the table mechanism including a first support section underlying a portion of the stack, means for incrementally raising the first support section; a second support section pivotally connected with one end of the first support section and being operable to carry an end portion of the stack; and vertically stationary means engageable with said second section for varying the inclination of the second support section relative to the first support section, in response to raising movement of the first support to compensate for uneven dimensional variances of the stack occurring during depletion thereof.

3. A bag-supporting magazine for use with a packaging assembly having means for opening bags and inserting articles thereinto, the magazine comprising: a table mechanism operable to carry an irregularly-shaped stack of collapsed bags in a manner tending to maintain the uppermost bag in a selected posture, the table mechanism including a first support section underlying a portion of the stack, means for incrementally raising the first support section; a second support section pivotally connected with one end of the first support section and being operable to carry an end portion of the stack; and means for varying the inclination of the second support section relative to the first support section, in response to raising movement of the first support section to compensate for uneven dimensional variances of the stack occurring during depletion thereof; the second support section being inclined initially downwardly with respect to the first support section and the means varying the inclination comprising cam means, and cam follower means connected to the second support section, in position to engage the cam means upon raising movement of the support sections.

4. A bag-supporting magazine for use with a packaging assembly having means for opening bags and inserting articles thereinto, the magazine comprising: a table mechanism operable to carry an irregularly-shaped stack of collapsed bags in a manner tending to maintain the uppermost bag in a selected posture, the table mechanism including a first support section underlying a portion of the stack, means for incrementally raising the first support section; a second support section pivotally connected with one end of the first support section and being operable to carry an end portion of the stack; and means for varying the inclination of the second support section relative to the first support section, in response to raising movement of the first support section to compensate for uneven dimensional variances of the stack occuring during depletion thereof; the second support section being initially inclined upwardly with respect to the first support section and being operable to carry an end portion of the stack having a reduced thickness; the means for varying the inclindation of the second support section comprising: cam means, and follower means connected to the second support section in position for engagement with the cam means and operable to engage this cam means to swing the second support section toward a horizontal position as the first support section is being raised.

5. A bag-supporting magazine according to claim 4 wherein: said second support includes a pair of spaced support fingers pivotally secured to the first support section along a pivot axis spaced above the plane of the first support section; said fingers sloping downwardly from the pivot axis toward the first support section and passing through a pair of spaced slots located in the first support section.

6. A bag-supporting magazine for use with a packaging assembly having means for opening bags and inserting articles thereinto, the magazine comprising: a table mechanism operable to carry an irregularly-shaped stack of collapsed bags in a manner tending to maintain the uppermost bag in a selected posture, the table mechanism including a first support section underlying a portion of the stack, means for incrementally raising the first support section; a second support section pivotally connected with one end of the first support section and being operable to carry an end portion of the stack; and means for varying the inclination of the second support section relative to the first support section, in response to raising movement of the first support section to compensate for uneven dimensional variances of the stack occuring during depletion thereof, and further including a third support section pivotally connected with the opposite end of the first support section; the third support section being initially inclined upwardly with respect to the first support section and being operable to carry an end portion of the stack having a reduced thickness; and means for varying the inclination of the third support section relative to the first support section in response to raising movement of the first support section substantially to a horizontal posture in a manner tending to compensate for uneven dimensional variances of the stack occurring during depletion thereof.

7. A bag-supporting magazine for use with a packaging assembly having means for opening bags and inserting articles thereinto, the magazine comprising: a table mechanism operable to carry an irregularly-shaped stack of collapsed bags in a manner tending to maintain the uppermost bag in a selected posture, the table mechanism including first and second support sections pivotally connected together for relative swinging movement; means for bodily raising said first and second support sections; and vertically stationary means engageable with at least one of said support sections for varying the relative inclination of the first and second support sections in response to raising movement of the support sections.

8. a package sealing assembly comprising: support means operable to carry a package having an open end, a pair of horizontally spaced tucker arms disposed at opposite sides of the support means substantially in alignment with each other, means for shifting said tucker arms horizontally inwardly against opposite sides of the open end of the package to fold in the sides of the open end, a pair of vertically spaced heat-sealing jaws disposed adjacent said tucker arms, drive means connected to one of said jaws for shifting said one heat-sealing jaw vertically inwardly, means drivingly connecting said one jaw with the other of said jaws so that motion of said one jaw is transmitted from said one jaw to said other jaw whereby both jaws are driven toward the folded sides of the open end to seal the flaps thereof closed; means mounting the support means for reciprocal sliding movement forwardly toward and rearwardly away from the tucker arms and sealing jaws; and means connected to the support means for shifting the support means rearwardly to move the package located thereon from between the tucker arms and the sealing jaws, in response to the sealing of the package; ejector means for transferring the package from the support means in response to rearward shifting of the support means, the ejector means comprising a plunger arm mounted for reciprocal movement laterally across the support means; a stop plate disposed adjacent to and above the other end of the support means; said stop extending generally vertically in the path of movement of the package and operable to define the rearward limit for a package being transferred to the support means; wherein the means for shifting said support means comprises: a rotatably mounted shaft; power means for oscillatably rotating the shaft; first linkage means connected between the shaft and the support means for shifting the support means in response to rotation of the shaft; and second linkage means connected between the shaft and the stop plate to shift the stop plate rearwardly in response to rotation of the shaft.

9. A package sealing assembly according to claim 8 including a pivotal support for the stop plate enabling the stop plate to maintain a generally vertical posture during rearward shifting thereof.

10. An article packaging assembly comprising: article feeding means; package sealing means; and means for supporting a receptable in open position between and in general alignment with the article feeding means and the package sealing means; said article feeding means comprising article transfer means having a supporting surface for underlying and supporting a quantity of articles that are delivered thereto; a second surface spaced at a lover elevation than the firstmentioned surface, means for reciprocating the article transfer means: is a first direction away from underlying support of a selected plurality of said articles to displace the selected articles to the lower level of the second surface, thereafter in the opposite direction to engage and push said selected plurality of articles into the receptacle, and for continuing to shift said arm means in said opposite direction to push the receptacle to the package sealing means; said package sealing means including means for sealing the receptacle closed after the articles are inserted therein.

11. An article packaging assembly according to claim 10 wherein the package sealing means comprises: guide means operable to support a receptacle with an open end; a pair of horizontally spaced tucker arms disposed at one end of the guide means; means for shifting said tucker arms horizontally inwardly against opposite sides of the open end of the receptacle to fold-in the sides of the open end in response to the positioning of a package onto the guide means; a pair of vertically spaced heat-sealing jaws disposed adjacent said one end of the guide means; and means for shifting the heat-sealing jaws vertically inwardly toward the folded sides of the open end to seal the flaps thereof closed in response to the positioning of a package on the guide means.

12. An article packaging assembly comprising: article feeding means including reciprocable arm means; package sealing means; and means for supporting a receptacle in open position between and in general alignment with the article feeding means and the package sealing means; means for shifting said arm means in a direction to push a selected quantity of articles into the receptable and for continuing to shift said arm means in said direction to push the receptacle to the package sealing means; said package sealing means including means for sealing the receptacle closed after the articles are inserted therein; said arm means comprises a plurality of arms mounted for reciprocal movement and having supporting surfaces operable to underlie and support a plurality of articles, and having pushing surfaces operable to push the articles; power means for reciprocating the arms rearwardly from beneath a selected quantity of articles causing the articles to be downwardly displaced, and forwardly to engage the displaced articles by the pushing surfaces and to push the articles toward the receptacle.

13. An article packaging assembly according to claim 12 including means for causing reciprocation of the arms in response to the articles reaching a predetermined location along the supporting surfaces.

14. An article packaging assembly according to claim 10 wherein said supporting means comprises: a table mechanism operable to carry an irregularly-shaped stack of collapsed bags in a manner tending to maintain the uppermost bag in a selected posture, the table mechanism including first and second support sections operably connected together for relative swinging movement; means for raising said first and second support sections in response to the transfer of bags from the stack to the package sealing means; and means for varying the relative inclination of the first and second support sections in response to raising movement of the support sections.

15. An article packaging assembly comprising:
guide means;
article transfer means for depositing a selected quantity of articles onto said guide means, said article transfer means comprising:
arm means located above said guide means and mounted for reciprocal movement, said arm means including a supporting surface operable to underlie and support the selected quantity of articles, and
pushing means operable to advance the selected quantity of articles;
means for sliding a plurality of articles along said supporting surface;
means for carrying a normally-closed receptacle ahead of said guide means;
power means for reciprocating the arm means:
rearwardly from beneath the selected quantity of articles and relative to said guide means causing the selected quantity of articles to be displaced downwardly onto said guide means, and forwardly relative to said guide means to move the pushing means into pressure relation with the selected quantity of articles;

means for opening the receptacle; and means actuable by articles on said supporting surface for actuating the receptacle opening means.

16. An article packaging assembly according to claim 15, including guide wings, means mounting the guide wings for movement into and out of positions to direct the articles into the receptacle, and means actuated by the arm means for effecting movement of the guide wings into and out of said positions.

17. A bag-supporting magazine for use with a packaging assembly having means for opening bags and inserting articles thereinto, the magazine comprising: a table mechanism operable to carry an irregularly-shaped stack of collapsed bags in a manner tending to maintain the uppermost bag in a selected posture, the table mechanism including first and second support sections pivotably connected together for relative swinging movement; means for bodily raising said first and second support sections; and means for varying the relative inclination of the first and second support sections in response to raising movement of the support sections; said second support section is inclined initially downwardly with respect to the first support section and means for varying the inclination comprising: cam means, and cam follower means connected to the second support section in position to engage the cam means upon raising movement of the support sections.

18. A package sealing assembly comprising: reciprocable support means operable to carry a package having an open end, a pair of horizontally spaced tucker arms disposed at opposite sides of a forward end of the support means substantially in alignment with each other, means for shifting said tucker arms horizontally inwardly against opposite sides of the open end of the bag to fold in the sides of the open end, a pair of vertically spaced heat-sealing jaws disposed adjacent said tucker arms, means for shifting the heat-sealing jaws vertically inwardly toward the folded sides of the open end to seal the flaps thereof closed; stop means disposed above a rearward end of said support means to abut the package and position the open end of the package between said tucker arms and jaws for folding and sealing; means for shifting said stop means to permit rearward travel of the bag, and for shifting said support means rearwardly to move the package from between said tucker arms and said jaws.

* * * * *